US007084360B2

(12) United States Patent
Schmidt et al.

(10) Patent No.: US 7,084,360 B2
(45) Date of Patent: Aug. 1, 2006

(54) ELASTOMERIC VEHICLE CONTROL SWITCH

(75) Inventors: Robert M. Schmidt, Livonia, MI (US); Mark G. Feldman, Farmington Hills, MI (US); Robert Amundson, Howell, MI (US)

(73) Assignee: Lear Corporation, Southfield, MI (US)

( * ) Notice: Subject to any disclaimer, the term of this patent is extended or adjusted under 35 U.S.C. 154(b) by 37 days.

(21) Appl. No.: 10/901,493

(22) Filed: Jul. 28, 2004

(65) Prior Publication Data

US 2006/0021861 A1 Feb. 2, 2006

(51) Int. Cl.
*H01H 9/26* (2006.01)

(52) U.S. Cl. ..... 200/5 R; 200/5 A

(58) Field of Classification Search ..... 200/5 A, 200/339, 310–314, 341, 317, 343–345, 510–520
See application file for complete search history.

(56) References Cited

U.S. PATENT DOCUMENTS 3,995,128 A * 11/1976 Hawkins ..... 200/5 A
3,996,427 A * 12/1976 Kaminski ..... 200/5 A
4,618,744 A 10/1986 Pope et al.
5,087,798 A 2/1992 Rohde et al.
5,340,953 A * 8/1994 Krebs et al. ..... 200/86.5
5,386,090 A 1/1995 Hofmann
5,434,377 A * 7/1995 Martin et al. ..... 200/314
5,493,082 A 2/1996 Bloch et al.
5,512,718 A * 4/1996 Larose ..... 200/314
5,521,342 A 5/1996 Bartley et al.
5,570,114 A * 10/1996 Fowler ..... 345/173
5,612,692 A * 3/1997 Dugas et al. ..... 341/22
5,743,380 A 4/1998 Gauker
6,040,534 A 3/2000 Beukema
6,046,415 A 4/2000 Briski
6,158,867 A * 12/2000 Parker et al. ..... 362/29
6,166,662 A * 12/2000 Chuang ..... 341/22
6,367,940 B1 4/2002 Parker et al.
6,504,492 B1 * 1/2003 Muurinen ..... 341/22
6,586,689 B1 * 7/2003 Kuriyama ..... 200/6 A
6,670,562 B1 * 12/2003 Kaneko ..... 200/1 B
6,683,265 B1 * 1/2004 Masuda ..... 200/406
6,737,596 B1 5/2004 Hein
6,765,158 B1 * 7/2004 Morrison et al. ..... 200/5 R
6,765,503 B1 * 7/2004 Chan et al. ..... 341/22
6,774,505 B1 8/2004 Wnuk

* cited by examiner

*Primary Examiner*—Michael Friedhofer
*Assistant Examiner*—Lisa Klaus
(74) *Attorney, Agent, or Firm*—MacMillan, Sobanski & Todd, LLC

(57) ABSTRACT

A vehicle control switch assembly for use with a printed circuit board is disclosed. The switch assembly includes an elastomeric pad and a support member. The elastomeric pad has a contact pad for selective engagement with an electrical contact of the printed circuit board. The support member is molded together with the elastomeric pad. A vehicle control switch assembly including a printed circuit board having an electrical contact, an elastomeric pad having a contact pad for selective engagement with the electrical contact of the printed circuit board, and a support member is also disclosed. The support member is positioned between the elastomeric pad and the printed circuit board to provide support for the elastomeric pad.

20 Claims, 4 Drawing Sheets

ELASTOMERIC VEHICLE CONTROL SWITCH

BACKGROUND OF THE INVENTION

This invention relates in general to vehicle control switch assemblies, and more specifically to control switches having an elastomeric pad.

A conventional switch bank (or array) is typically formed having a stacked (i.e., overlaid) structure. The switch bank is implemented to carry a low voltage DC signal. The switch bank is a group of normally open, single pole, single throw (NO, SP, ST) momentary contact device switches. The switch bank can include a graphic overlay having painted or printed on symbols that relate to numbers, vehicle functions, and the like depending on the application of the switch bank. For example, the overlay is disposed over an electrostatic discharge (ESD)/electromagnetic interference (EMI) shield. In another example, the overlay is disposed directly over a top membrane or elastomeric pad. The membrane has a number of contacts that align with the respective symbols when the switch bank is properly assembled.

The switch bank typically also includes a spacer disposed under the membrane. The spacer has holes that generally align with respective contacts in the membrane. A bottom membrane (or circuit board) includes circuit grids that generally align with the respective contacts such that a respective circuit is closed when a user sufficiently depresses the respective symbol. The switch bank can also include a subpanel (i.e., substrate, back cover, etc.) that generally provides physical support. The stackup or overlay of the respective symbol, contact, hole, and grid forms an individual switch in the switch bank.

The conventional switch bank has a number of deficiencies that include when the switch bank is manufactured, the layers (i.e., the overlay, the membrane, the spacer, the circuit board, and the sub-panel) can be difficult to align such that the respective symbols, holes, and circuits align properly, the switch bank is not lighted or backlit, the overlay and the symbols are not registered (i.e., the surface of the overlay is substantially smooth such that a user can not readily discern switch location and type by feel), and the switch bank does not provide tactile feedback feel to the user. Additionally, conventional switch banks, particularly rocker type switches with opposed contacts for first and second functions lack sufficient structural strength to prevent both contacts from being made when multiple forces are applied.

SUMMARY OF THE INVENTION

This invention relates to a vehicle control switch assembly for use with a printed circuit board. The switch assembly includes an elastomeric pad and a support member. The elastomeric pad has a contact pad for selective engagement with an electrical contact of the printed circuit board. The support member is molded together with the elastomeric pad.

The invention also relates to a vehicle control switch assembly. The assembly includes a printed circuit board having an electrical contact, an elastomeric pad having a contact pad for selective engagement with the electrical contact of the printed circuit board, and a support member. The support member is positioned between the elastomeric pad and the printed circuit board to provide support for the elastomeric pad.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Vehicle interior passenger compartments are, in large measure, conventional in the art. The typical vehicle interior passenger compartment includes an instrument panel or dashboard. The instrument panel may include control mechanisms and switches for various components of the vehicle, such as, temperature and climate controls system, audio and video systems, windows, seat and mirror positioning mechanisms, and navigational systems. These controls may be positioned within the instrument panel, a lower console, doors, or any other suitable location within the interior of the vehicle. Alternatively, a second storage compartment (not shown) may be provided in the back seat area and can also have various controls (climate, windows, video gaming device controls, audio controls, headphone jacks, etc.) located thereon. An overhead console (not shown) can also be accessible from within the interior passenger compartment of the vehicle. The overhead console can contain various controls, such as a garage door opener, climate controls, etc. A rear overhead console can include a video display screen, climate controls, and other audio controls. Other vehicle controls that are user modifiable typically include seat positions for a vehicle driver seat (fore/aft position, seat height, seat back angle, etc.), audio and video presets, rearview and side view mirror positions, temperature control settings, seat belt height, steering wheel position, accelerator/brake pedal positions, interior light colors and intensity, airbag activation and sensitivity conditions, and many other settings. The majority of these components are typically controlled electronically by switches. It should be appreciated that the scope of this invention is not intended to be limited for use with the specific structure and controls for the vehicle interior passenger compartment described above, or with vehicle interior passenger compartments in general. On the contrary, as will become apparent below, this invention may be used in any desired environment for the purposes described below.

Figure 1:
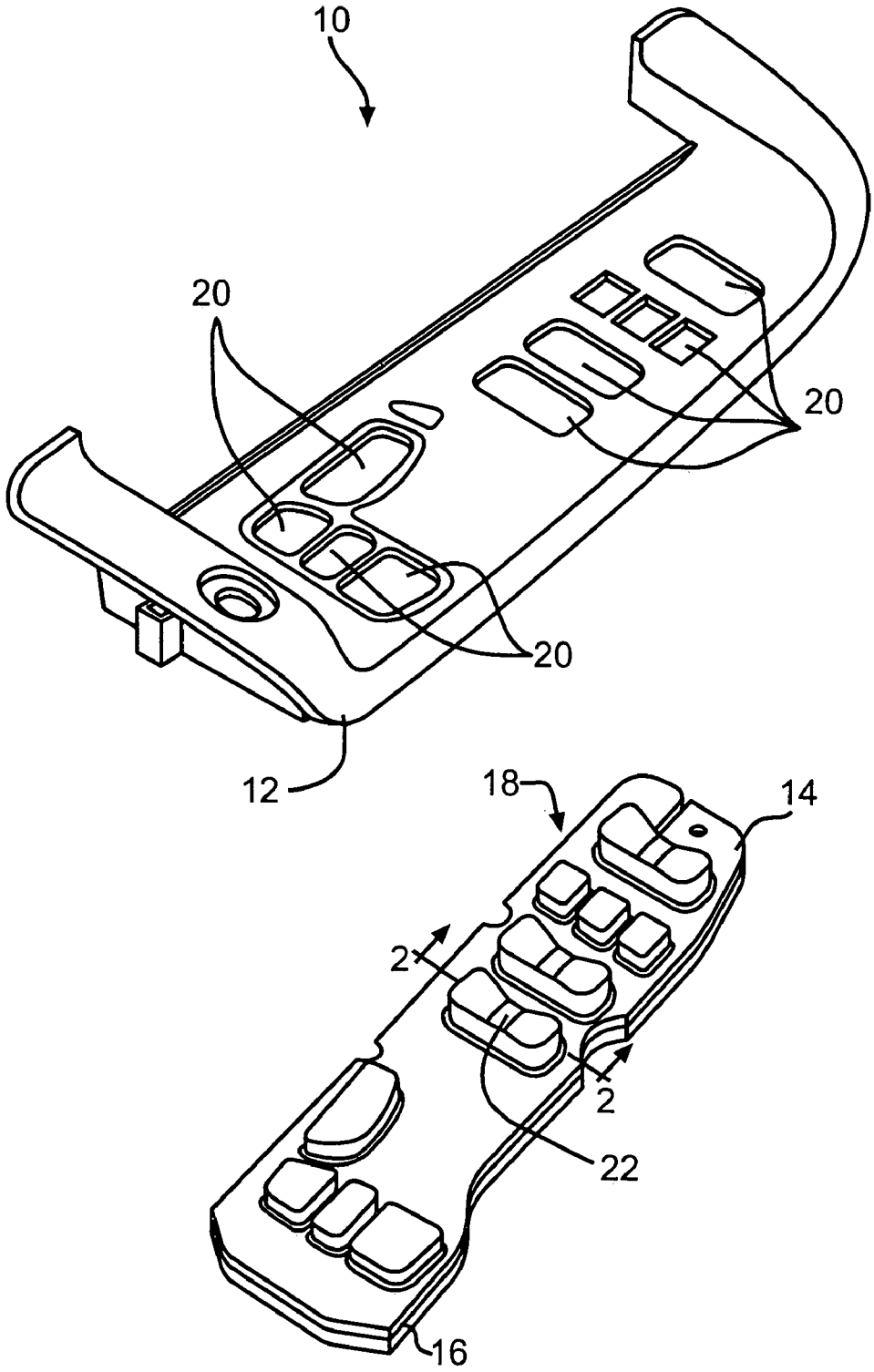
FIG. 1 is an exploded perspective view of a bezel housing and a switch assembly according to the present invention.

Referring now to the drawings, there is illustrated in FIG. 1 an exploded perspective view of a control switch assembly 10 including a bezel housing 12 and a switch assembly 14 underlying the housing 12 according to the present invention. The switch assembly 14 includes a plurality of layers or substrates 16 which will be described in greater detail below with respect to FIG. 2. The switch assembly 14 includes multiple control switches or buttons 18 that are each configured to actuate a control mechanism (not shown) that operates a device such as those listed above (i.e. vehicle seats, windows, etc.). The illustrated control switches 18 can be of a rocker type, push button type, slider type, or any other type of button that is moveable by a vehicle operator to control a designated vehicle operation. The housing 12 has a plurality of openings 20 formed through the housing 12. The housing 12 is configured to fit over the switch assembly 14 and the openings 20 are sized and shaped to fit over the control switches 18. The housing 12 also acts to generally position the switches 18. It is preferred that when the control switch assembly 10 is assembled, the control switches 18 protrude through the housing 12 such that the control switches 18 can be accessed by a vehicle operator. The housing 12 can be formed as a separate component to be assembled with another vehicle interior component, or can be integrally formed as part of a vehicle console, door panel or other vehicle interior component. The housing 12 is a vehicle interior component that is generally conventional in the art. The housing 12 may be disposed on the printed circuit board 30 and/or an elastomeric membrane or pad 34 (shown in FIG. 2). The housing 12 may be made of any conventional material used with switch assemblies or instrument panel housings. The housing 12 may include various other apertures or flanges to facilitate the mounting of the housing 12 to the circuit board 30 and/or elastomeric pad 34. The housing 12 may also include various other apertures or flanges to facilitate the mounting of the switch assembly 14 or other additional switch assemblies or for connecting the assembly 10 to the vehicle.

Figure 2:
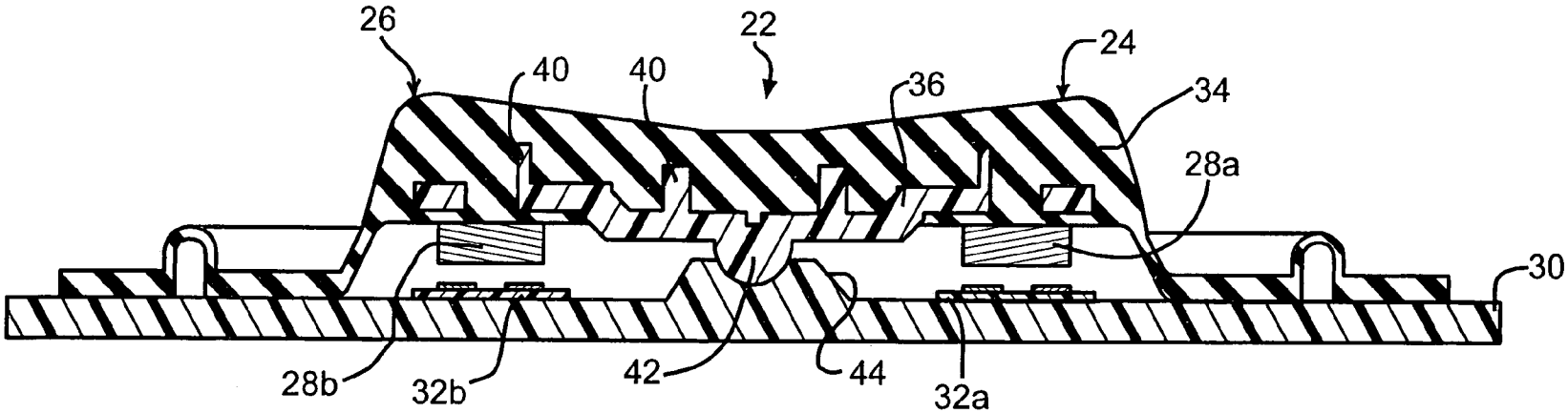
FIG. 2 is a cross-sectional view of the switch assembly of FIG. 1 through Line 2—2.

Illustrated in FIG. 2 is a cross-sectional view of one of the control switches 18 shown in FIG. 1 through the Line 2—2. The illustrated switch 22 is of a rocker-type that is configured to be in one of three positions. As illustrated, the switch 22 is in a neutral position. In the neutral position, the contact pads 28*a* and 28*b* formed on the switch are disengaged from an underlying circuit board 30. The circuit board 30 may be a conventional printed circuit board. The circuit board 30 may include conductive traces for implementing conventional switch functions. The circuit board 30 preferably includes a first contact 32*a* and a second contact 32*b*, for engagement with respective contact pads 28*a* and 28*b* formed on the switch 22, as is shown in FIG. 2. The circuit board 30 may include various contacts or conductive traces for implementing desired switch functions, as will be described herein in accordance with the present invention. In a first position, a first end 24 of the switch 22 would be depressed by an operator and, therefore, the switch 22 would be moved to a first actuation mode with the first contact pad 28*a* in electrical engagement with the first contact 32*a*. In a second position, a second end 26 of the switch 22 is depressed and, therefore, moved to a second actuation mode with the second contact pad 28*b* in electrical engagement with the second contact 32*b*. When the switch 22 is in either the first position or the second position, the respective opposite end of the switch 22 can be depressed to return the switch 22 to the neutral position or to the opposite position. That is, if the switch 22 is in a first position, it can be moved to a neutral position or to the second position by depressing the second end 26 of the switch 22. It can be appreciated that the switch 22 can have a plurality of stops (not shown) so that the switch 22 can be moved into and retained in the three (or more) positions. Alternatively, the switch 22 can be configured such that the switch 22 automatically returns to the neutral position after the switch 22 has been moved into either the first position or the second position by a spring or return mechanism.

The basic operation of the control switch apparatus 10 illustrated in accordance with the present invention are generally known in the art. Specifically, the switch 22 shown in FIG. 2 includes at least one contact pad 28*a* molded within an elastomeric pad 34. However, it will be appreciated that the switch 22 may be any switch apparatus having multiple switch contact pads 28*a* and 28*b* that are movable from a disengaged position in which the switch contact pads 28*a* and 28*b* are spaced apart from a corresponding contact 32*a* and 32*b* of the circuit board 30, as shown in FIG. 2, to an engaged position in which one of the switch contact pads 28*a* and 28*b* contacts the corresponding contact 32*a* and 32*b* of the circuit board 30. The switch contact pad 32*a* and 32*b* may remain in the disengaged position until the switch 22 moves the switch contact pad 28*a* and 28*b* into an engaged position. The switch contact pad 28*a* and 28*b* of the switch 22 may be a contact dome of a dome or membrane switch, although such is not required. The elastomeric pad 34 may form a switch housing to support the switch contact pads 28*a* and 28*b*. The switch housing may be any conventional switch housing adapted to support the switch contact pads 28*a* and 28*b*. The contact pads 28*a* and 28*b*, as shown, are positioned above the printed circuit board 30 that has a circuit grid (not shown). The switch 22 may also be disposed on a subpanel (i.e. substrate, back cover, etc.) that provides physical support to the switch 22. To actuate the switch 22, a user depresses a first end 24 or second end 26 of the switch 22. The portion of the switch 22 that is depressed moves the contact pad 28*a* or 28*b* towards the circuit board 30. The respective contact pad 28*a* or 28*b* contacts the grid at one of the corresponding contacts 32*a* or 32*b* to complete an electrical circuit. The contact pads 28*a* and 28*b* contacting the circuit board 30 provide tactile feel to the switch 22.

The elastomeric pad 34 may be a conventional elastomer pad suitable for use with switches, such as dome switches or membrane switches. The elastomeric pad 34 used herein may cover a portion of the circuit board 30 having the contacts 32*a* and 32*b* for the switch 22. It will be appreciated that the elastomeric pad 34 may cover an entire surface of the circuit board 30 or any portion thereof. At least a portion of the elastomeric pad 34 may transmit light therethrough or be adapted to be a light pipe, as will be described in greater detail below.

Figure 3:
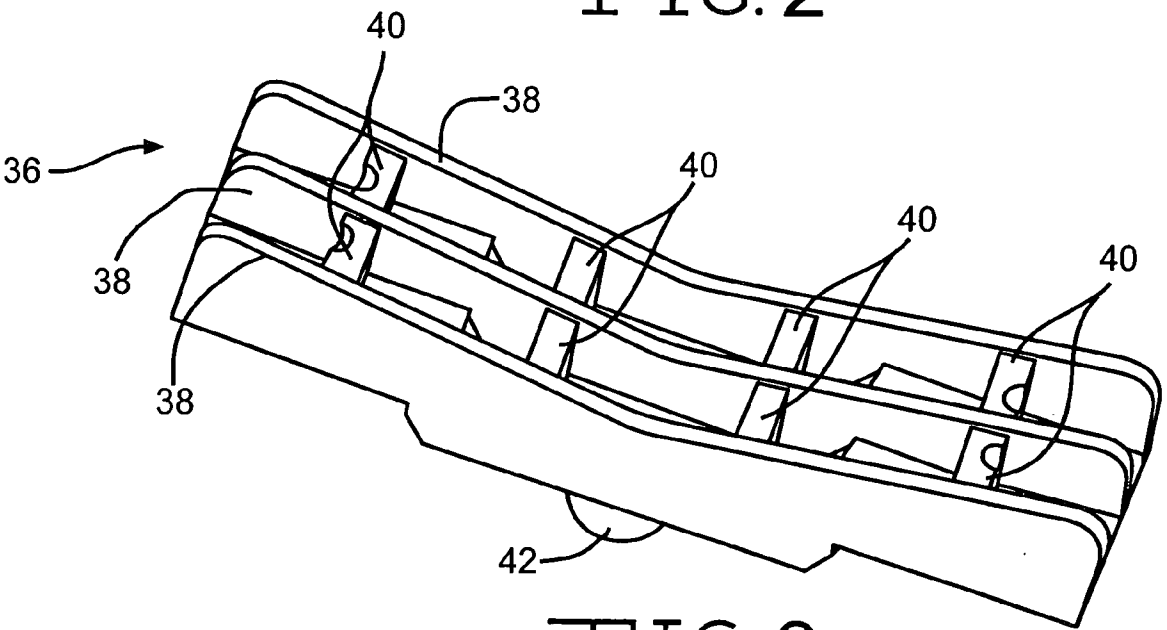
FIG. 3 is a perspective view of an insert positioned within the switch assembly according to the present invention.

Positioned adjacent the elastomeric pad 34 is a support member 36. The support member 36 can be made of any suitable material such that the support member 36 is more rigid than the elastomeric pad 34. In a preferred embodiment, the support member 36 is a plastic member. It should be appreciated that the support member can also be a semi-rigid plastic member, a flexible metal member, or an elastomeric member. The support member 36 is more clearly illustrated in FIG. 3. FIG. 3 is a perspective view of the support member that is positioned within the switch 22. The support member includes a plurality of longitudinally extending beams 38 joined by a plurality of cross-wise ribs 40. The ribs 40 and beams 38 can be molded as a single piece or can be formed as separate components that are joined together. Although the support member 36 is shown as having a plurality beams 38 joined by a plurality of ribs 40, it can be appreciated that the support member can have any suitable shape and structure. Formed at a lower portion of the support member 36 is a ball 42. The ball 42 is shown as a rounded protrusion extending from the bottom of the support member 36. The ball 54 is configured to cooperate with a pivot member 44 formed on the printed circuit board 30 for movement therewith. In the preferred embodiment of the rocker-type switch shown in FIG. 2, it is preferred that the pivot member 44 limits the motion of the switch 22 to the three positions described above. However, the switch 22 can be configured to be positioned in an infinite number of positions between the first and second positions. The pivot member 44 or the ball 42 can include features that further limit any other motion of the elastomeric pad 34 and support member 36 in axes other than those for which the switch 22 is designed. The pivot member 44 can be made from the same material as the printed circuit board 30 and formed integrally therewith, or it can be made from any suitable material and attached to the circuit board 30.

The support member 36 is configured to provide feel and support for the elastomeric pad 34. When the elastomeric pad 34 is depressed by a user, the elastomeric pad 34 compresses and forces the first end 24 or second 26 of the support member 36 in the direction of the force applied by the user. The support member 36 also is used to provide lateral support for the switch 22 such that if the force applied by the user is in an axis not directly aligned with the end 24 and 26 of the switch 22, and therefore aligned with the respective contact pad 28*a* and 28*b* and corresponding contacts 32*a* and 32*b*, the support member 36 maintains the structural rigidity of the switch 22 and allows the indirect force applied by the user to act upon the support member 36 as if a direct force were applied to it. Thus, the application of force upon the switch, regardless of whether the applied force is direct or indirect, will cause the contact pad 32*a* or 32*b* that is at the end 24 and 26 of the switch 22 being depressed to travel into engagement with the corresponding contact 32*a* or 32*b*, according to the desires of the user. Additionally, the support member 36 will prevent both ends 24 and 26 of the switch 22 from being depressed simultaneously and prevent both contact pads 28*a* and 28*b* to engage the contacts 32*a* and 32*b* which could create a conflict of signal information. For example, if the rocker-type switch 22 is for locking and unlocking the vehicle doors, depressing both ends 24 and 26 of the switch 22 cannot, using the support member 36 according to the present invention, cause a locking mechanism to simultaneously lock and unlock the door or cause a conflicting signal to be sent to a control device.

In the preferred embodiment, the elastomeric pad 34 is molded to the support member 36 to secure the two components together. In the embodiment shown in FIG. 2, the support member 36 is molded to a lower portion of the elastomeric pad 34. However, it can be appreciated that the support member 36 can be molded entirely within the elastomeric pad 34. The various beams 38 and ribs 40 of the support member 36 help to retain the elastomeric pad 34 with the support member 36. The support member 36 can also include additional roughed surfaces, divots or other features to help retain the elastomeric pad 34 with the support member 36 during a molding operation.

Figure 4:
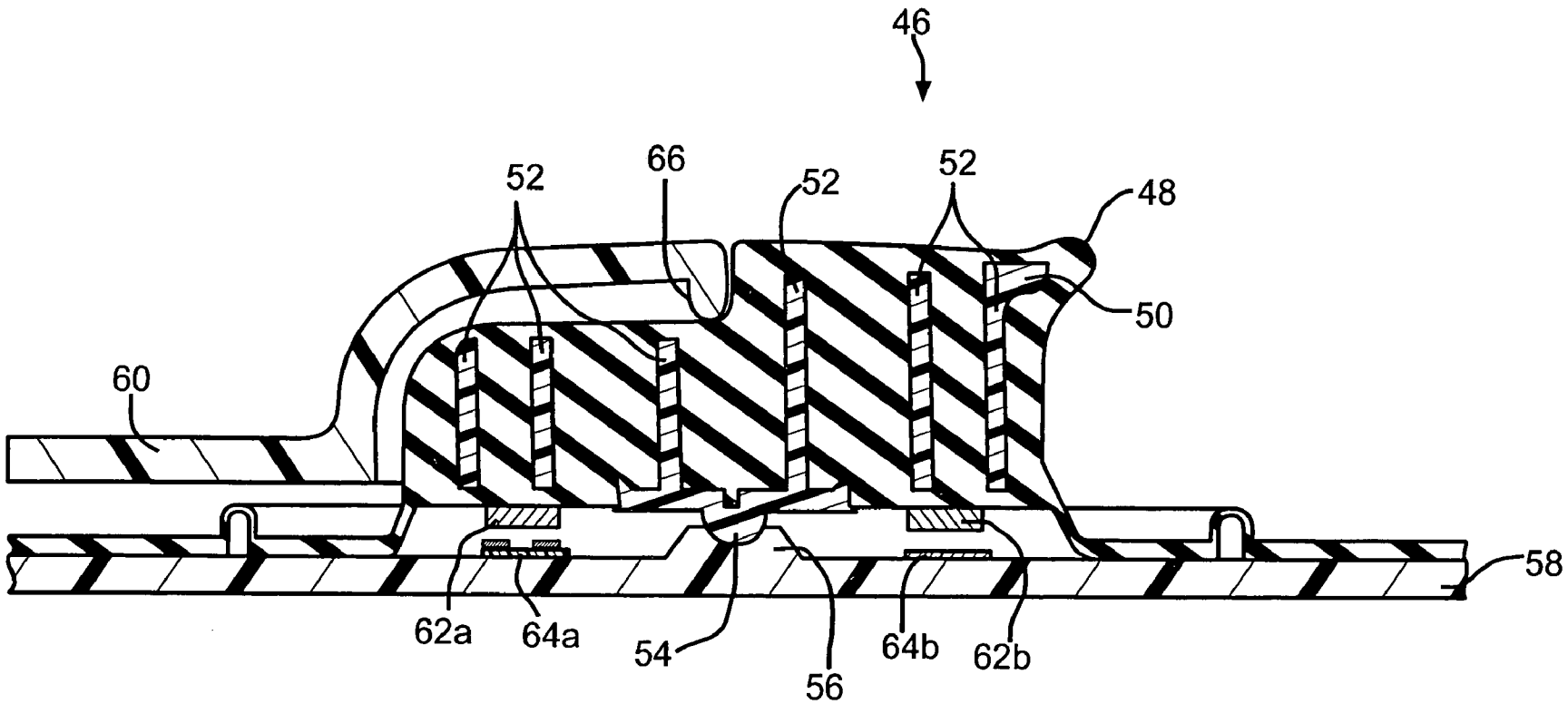
FIG. 4 is a cross-sectional view of an switch assembly according to an alternate embodiment of the present invention.

Illustrated in FIG. 4 a cross-sectional view of an alternate embodiment of a switch 46 that can be used with the switch assembly 14 according to the present invention. The switch 46 includes an elastomeric pad 48 molded about a support member 50. As with the embodiment of a switch described above, the support member 50 can be formed having a plurality of beams (not shown) interconnected by a plurality of ribs 52. The second switch 46 can generally be described as a rocker-type switch insofar as the switch 46 is movable between one of three positions (a first position, a second position, and a neutral position), as was described above with respect to FIG. 2. As with the switch 22 shown in FIG. 2, the switch 46 includes a pair of opposed contact pads 62*a* and 62*b* and contacts 64*a* and 64*b* that are used to control the operation of the switch 46 when activated by a user. The switch 46 is shown in FIG. 4 as being in a neutral position (neither contact pad 62*a* and 62*b* is in engagement with a respective contact 64*a* and 64*b*). The switch 46 is configured to cooperate with a printed circuit board 58 in a manner similar to that of the switch 22 shown in FIG. 2. Similarly, contacts 64*a* and 64*b* are preferably formed on the circuit board 58. The circuit board 58 also includes a first pivot 56 that is configured to cooperate with a ball 54 formed on the support member 50. As with the switch 22 of FIG. 2, the ball 54 and first pivot mechanism 56, as well as the position of the switch 46 within a housing 60 restrains the switch 46 from unwanted movement. A second pivot 66 is formed integrally with the housing 60 and supports the pivoting motion of the switch 46. Although the switch 46 will move relative to both pivot points (first pivot 56 and second pivot 66) when the switch 46 is operated, the primary pivot point will be pivot 56 when the switch 46 is pushed (moved to engage contact pad 62*a* and contact 64) and will be the second pivot 66 when the switch 46 is pulled (moved to engage contact pad 62*b* and contact 64*b*). In addition, the support member 50 prevents both contact pads 62*a* and 62*b* from simultaneously engaging both contacts 64*a* and 64*b*.

Preferably, the switch 46 also includes a return mechanism (not shown) that automatically returns the switch 46 from one of the first and second positions to the neutral position after the switch 46 is released. The return mechanism would cooperate with a ball 54 and pivot 56 mechanism of the switch 46. When the switch 46 is pivoted up so that contact pad 62*a* engages contact 64*a*, a first pivot return would act against the switch 46 and causes the switch 46 to return to the neutral position when the switch 46 is released. When the switch 46 is pivoted down so that contact pad 62*b* engages contact 64*b*, a second pivot return would act against the switch 46 and cause the switch 46 to return to the neutral position when the switch 46 is released. An example of a switch 46 having this configuration is a window control switch in a vehicle. Typically, since a window can be opened or closed to varying degrees, the switch such as shown in FIG. 4 is held in an engaged position until the desired degree of openness is achieved.

Figure 5:
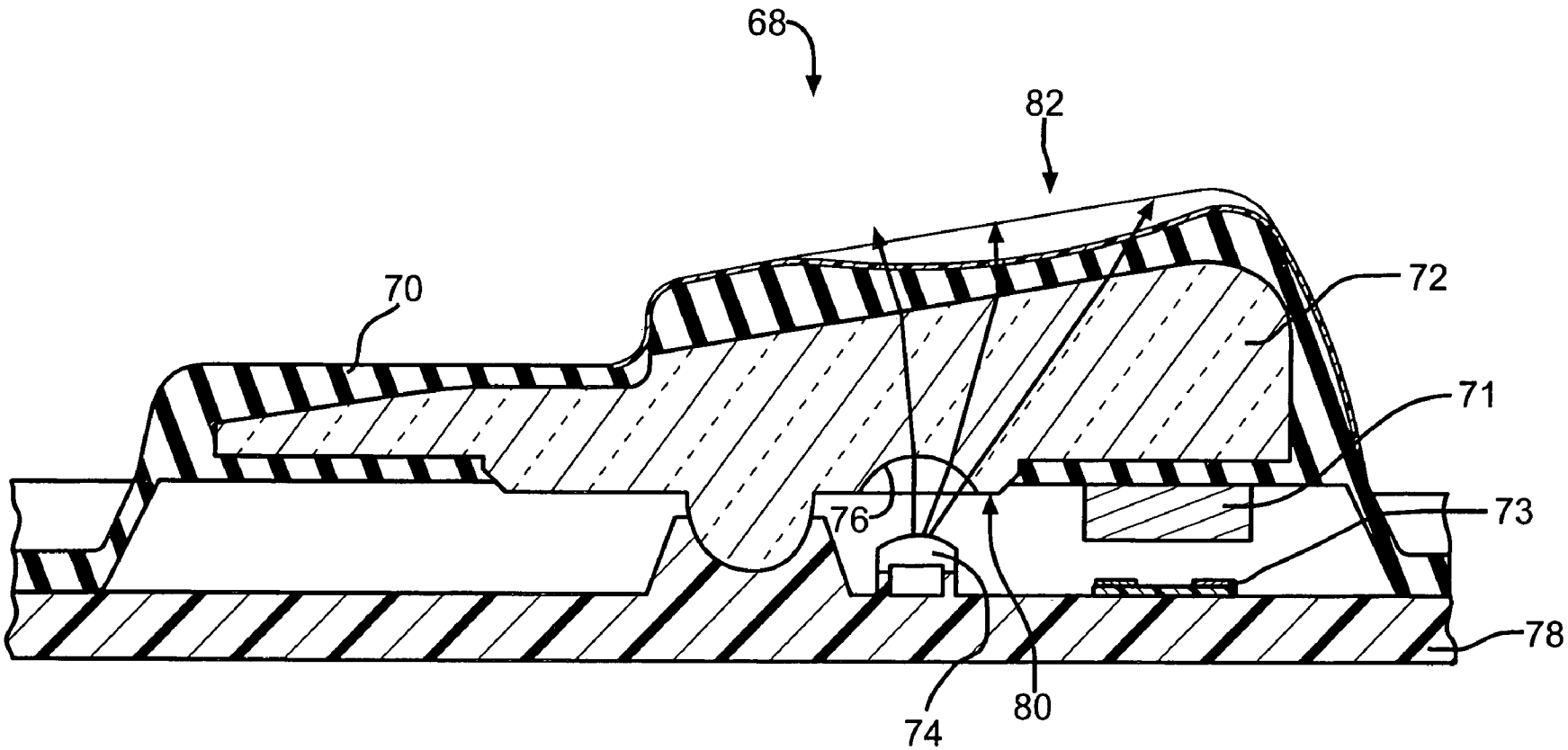
FIG. 5 is a cross-sectional view of an switch assembly including a light pipe according to an alternate embodiment of the present invention.

FIG. 5 is a cross-sectional view of an alternate embodiment of a switch 68 for the switch assembly 14. According to this embodiment of the invention, the switch 68 includes a light pipe. The switch 68 is similar in structure and switch operation to the switches 22 and 46 described above and therefore, will only be described in detail with respect to those elements that are distinct from those embodiments. Unique to this switch 68 versus those described above is that the switch 68 only includes a single contact pad 71 and a contact 73. Therefore, although this type of switch 68 moves in a rocking motion, it can be considered a push-button switch. An alternate version of a push-button switch includes a single contact pad and one contact and primarily moves in a single axis. The switch 68 includes an elastomeric pad 70, a support member 72 molded together with the elastomeric pad 70 for providing rigidity to the switch 68, as was described above, and a printed circuit board 78. However, the support member 72 according to this embodiment of the invention functions as a light pipe in addition to performing a structural support function. The purpose and operation of light pipes is generally known in the art in that light pipes are used in automobile settings to transfer light from an inner portion a vehicle part to a visible portion of the vehicle component to illuminate a surface of the component.

Any of a plurality of types of light sources can be used to illuminate the light pipe, including an incandescent bulb or a light-emitting diode (LED), a lens, and a reflector or collimating surface for directing the light toward the lens.

Sometimes, more than one light source is used. In the preferred embodiment, an LED 74 is used with the switch 68. An LED 74 is a low voltage device that typically has a longer life than incandescent lamps. In addition, an LED 74 responds quickly to changes in current and produces a spectrum of light that is well defined and constrained. The support member/light pipe 72 has a light receiving end 80 and a light exiting end 82, and is continuous through the entirety of its cross section. It is preferred that the support member 72, is made of a material that has an index of refraction significantly higher than that of air. The LED 74 has one or more electrical connectors (not shown) and attaches the LED 74 to the printed circuit board 78 to form an electrical connection therewith. The light receiving end 80 of the support member 72 serves to introduce light into the support member 72. The light receiving end 80 can be the narrower, while the light exiting end 82 is the wider end of the support member. However, such a structure is not required. It is also preferred that the light receiving end 80 of the support member 72 includes a lens 76 for directing the light from the LED 74 through the support member 72. When the LED 74 is positioned at the focal point of a parabolic surface of the lens 76, some of the light strikes the parabolic surface. The light reflected from the parabolic surface travels in a trajectory generally parallel to the axis of revolution of the parabolic surface. Thus, the LED 74 produces a well-collimated light through the light pipe.

At least a portion of the elastomeric pad 70 may filter light therethrough. For example, a portion of the elastomeric pad 70 may transmit light therethrough and may be a translucent color, such that the light transferred therethrough is tinted to a desired color. It will be appreciated that at least a portion of the elastomeric pad 70 may be comprised of various layers of elastomer, each layer having various light transmission and/or filtering capabilities. The transmission or filtration of light through the elastomeric pad 70 may be desirable to illuminate an indicator or graphic on the switch 68 or on a portion of a housing disposed over a portion of the elastomeric pad 70. Alternatively, a graphic can be printed directly onto the elastomeric pad (such as a molded through graphic), or a translucent overlay having a graphic printed or etched thereon on can be positioned over a portion of the elastomeric pad. Regardless of the manner in which a graphic or indicator is made for the switch, the LED and light pipe act to illuminate (back-light) the graphic for ease of viewing by the user of the vehicle.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A switch assembly comprising:

an elastomeric pad having an electrically conductive contact pad molded within the elastomeric pad; and a separate rigid support member, wherein the support member is molded together with the elastomeric pad.

2. The switch assembly defined in claim 1 wherein the elastomeric pad is molded around the support member.

3. The switch assembly defined in claim 1 wherein the elastomeric pad covers at least a portion of the support member.

4. The switch assembly defined in claim 1 wherein the switch is a rocker-type switch, and the support member includes a ball, wherein a substrate layer includes a pivot engaged with the ball of the support member.

5. The switch assembly defined in claim 1 wherein the switch is a push-button type switch.

6. The switch assembly defined in claim 1 wherein a translucent overlay is positioned over the elastomeric pad.

7. The switch assembly defined in claim 1 wherein an outer surface of the elastomeric pad includes a graphic that is one of painted and etched thereon.

8. The switch assembly defined in claim 1 wherein a portion of the elastomeric pad and the support member are translucent.

9. The switch assembly defined in claim 1 wherein the support member is a light pipe.

10. The switch assembly defined in claim 9 further comprising a light source, the light source being positioned adjacent the support member.

11. The switch assembly defined in claim 1 further comprising a printed circuit board having an electrical contact;

wherein the contact pad is movable for selective engagement with the electrical contact of the printed circuit board; and the support member is positioned between the elastomeric pad and the printed circuit board to provide support for the elastomeric pad.

12. A switch assembly comprising:

a substrate portion;

an elastomeric pad covering at least a portion of the substrate portion;

a first switch having a first rigid support member in moving engagement with the substrate portion and a first electrically conductive contact pad; and a second switch having a second rigid support member separate from the first rigid support member, the second support member being in moving engagement with the substrate portion and a second electrically conductive contact pad;

wherein the first and second contact pads and the first and second support members are molded within the elastomeric pad.

13. The switch assembly defined in claim 12 wherein one of the first support member and the second support member is a light pipe.

14. The switch assembly defined in claim 13 further comprising a light source positioned adjacent the light pipe for transmitting light therethrough.

15. The switch assembly defined in claim 14 wherein at least a portion of the elastomeric pad is translucent for transmitting light from the light pipe through the elastomeric pad.

16. The switch assembly defined in claim 12 wherein the elastomeric pad includes a plurality of contact pads configured to cooperate with a plurality of contacts formed on a substrate layer.

17. The switch assembly defined in claim 12 wherein an outer surface of the elastomeric pad has a graphic one of printed and etched thereon.

18. The switch assembly defined in claim 12 wherein the switch is a push-button switch.

19. A switch assembly comprising:

an elastomeric pad having an electrically conductive contact pad, wherein a portion of the elastomeric pad is configured to allow light to pass therethrough; and a separate rigid support member molded together with the elastomeric pad, and wherein the support member is a light pipe.

20. The switch assembly defined in claim 19 wherein the contact pad is molded within the elastomeric pad.

* * * * *